US011274637B1

(12) United States Patent
Rejeti et al.

(10) Patent No.: US 11,274,637 B1
(45) Date of Patent: Mar. 15, 2022

(54) METHODS AND SYSTEMS FOR EGR SYSTEM

(71) Applicant: Ford Global Technologies, LLC, Dearborn, MI (US)

(72) Inventors: Sitaram Rejeti, Farmington, MI (US); Sumanth Reddy Dadam, New Hudson, MI (US); Edward Doemer, Dearborn Heights, MI (US); Robert Jentz, Westland, MI (US); Dave Hagner, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/202,129

(22) Filed: Mar. 15, 2021

(51) Int. Cl.
*F02M 26/49* (2016.01)
*F02M 26/48* (2016.01)
*F02M 26/47* (2016.01)

(52) U.S. Cl.
CPC ..... *F02M 26/49* (2016.02); *F02M 26/47* (2016.02); *F02M 26/48* (2016.02)

(58) Field of Classification Search
CPC ..... F02M 26/49; F02M 26/47; F02M 26/48
See application file for complete search history.

(56) References Cited

U.S. PATENT DOCUMENTS 8,042,528 B2 * 10/2011 Gates ..... F02D 41/0072 123/568.21
9,593,521 B2 3/2017 Breed
2014/0261343 A1 * 9/2014 Martin ..... F02D 29/02 123/568.21

FOREIGN PATENT DOCUMENTS

CN 101285531 A 10/2008
CN 106415202 A 2/2017
JP 5066556 B2 11/2012

* cited by examiner

*Primary Examiner* — Xiao En Mo
(74) *Attorney, Agent, or Firm* — Geoffrey Brumbaugh; McCoy Russell LLP

(57) ABSTRACT

Methods and systems are provided for a high-pressure exhaust gas recirculation system. In one example, the high-pressure exhaust gas recirculation system comprises pressure sensors arranged on different sides of an EGR valve. Feedback from the pressure sensors are used to diagnose a EGR valve position sensor.

20 Claims, 6 Drawing Sheets

METHODS AND SYSTEMS FOR EGR SYSTEM

FIELD

The present description relates generally to diagnosing a position sensor for an exhaust-gas recirculation (EGR) valve of an EGR system.

BACKGROUND/SUMMARY

Engine systems may utilize recirculation of exhaust gas from an engine exhaust system to an engine intake system, a process referred to as exhaust gas recirculation (EGR), to reduce regulated emissions. An EGR valve may be controlled to achieve a desired intake air dilution for a given engine operating condition. Traditionally, the amount of low pressure EGR (LP-EGR) and/or high pressure EGR (HP-EGR) routed through the EGR system may be measured and adjusted based on engine speed, engine temperature, and load during engine operation to maintain desirable combustion stability of the engine while providing emissions and fuel economy benefits. EGR effectively cools combustion chamber temperatures thereby reducing $NO_x$ formation.

In some existing implementations of EGR systems, EGR delivery may be measured via a fixed orifice and a pressure drop sensed across the orifice. The orifice pressure drop may be measured by a differential pressure sensor or two discrete pressure sensors, one of each side of the orifice. An orifice EGR flow measurement may be possible via characterizing a relationship between flow and the orifice pressure drop. The relationship may be stored in memory and retrieved during future EGR flow conditions to adjust EGR measured flow rate. The EGR measured flow rate can then be used by a controller to adjust an engine airflow, an in-cylinder fuel/air mixture burn rate, an engine output torque, and as a feedback signal in a closed loop EGR flow controller configuration, in which EGR flow is regulated by a valve separate from the fixed orifice.

Other examples of EGR systems include measuring the EGR flow delivered by measuring or estimating a pressure drop across an EGR control valve. The EGR control valve measurement may characterize a relationship between flow and the orifice pressure drop. The value may be stored and used to adjust conditions similar to those described above. EGR flow measurements in either of these configurations may be dependent on the accuracy of the pressure sensors and or a position sensor of the EGR valve. While diagnostics for the pressure sensors exist, diagnostics for the position sensor remain desired. Furthermore, since a duty cycle of the EGR valve may be based on feedback from the position sensor, recalibrations of the position sensor may be desired based on the diagnostic.

In one example, the issues described above may be addressed by a method for inferring an EGR valve position sensor functionality based on a blowdown peak pressure during a closed EGR valve operation and at least one open EGR valve position. In this way, a differential pressure across the valve may be used to diagnose the EGR valve position sensor.

As one example, during a steady state operation, the EGR valve may be commanded to a fully closed position. A blowdown peak pressure may be sensed at an exhaust gas pressure sensor and an EGR pressure sensor. A differential pressure may be calculated based on a difference between feedback from the exhaust gas pressure sensor and the EGR pressure sensor. Feedback from the EGR valve position sensor may be compared to the differential pressure to diagnose a condition of the EGR valve position sensor. Additionally, the comparison may be used to calibrate the EGR valve position sensor, which may result in a duty cycle adjustment during future EGR valve actuations.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
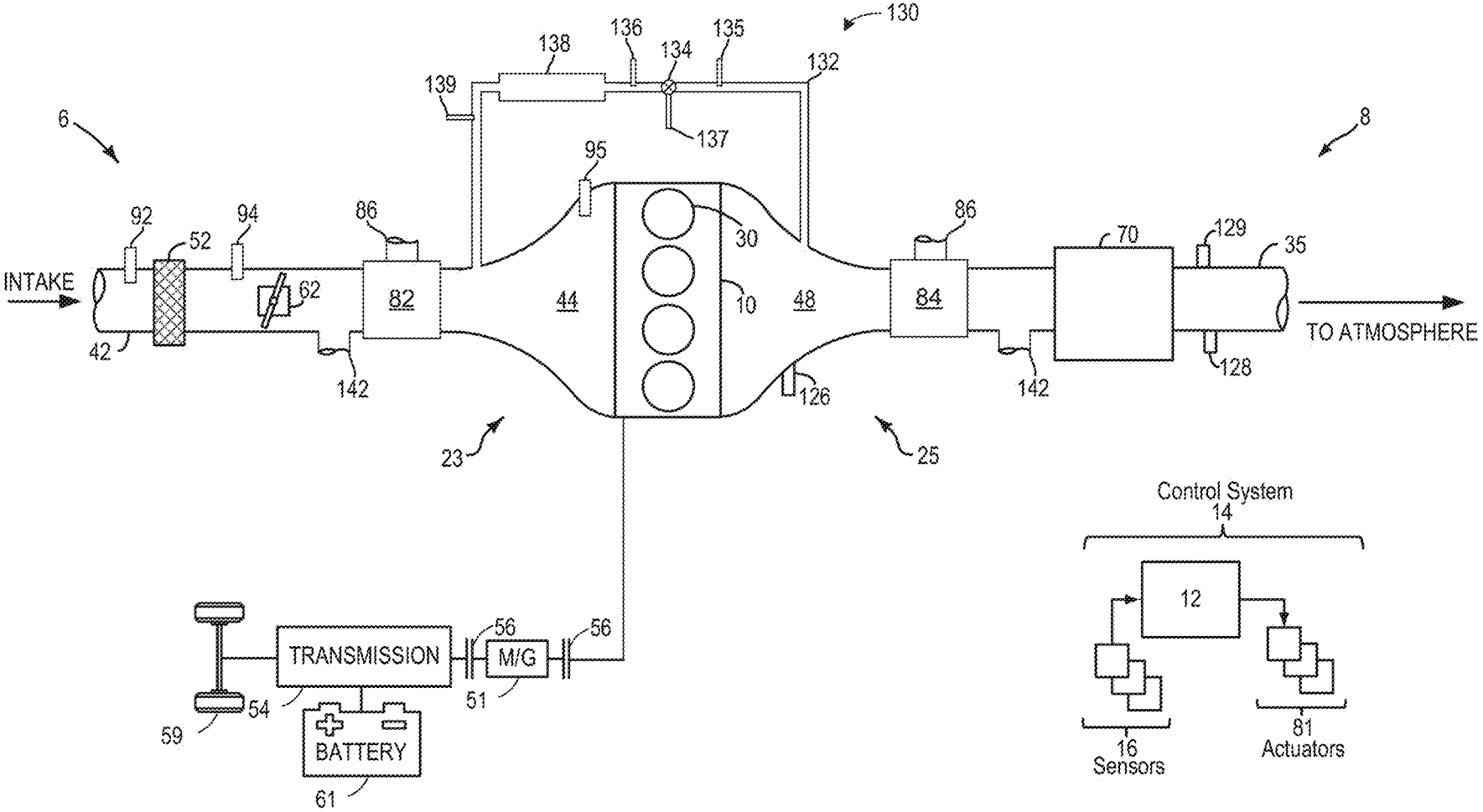
FIG. 1 illustrates a schematic of an engine included in a hybrid vehicle.
Figure 2:
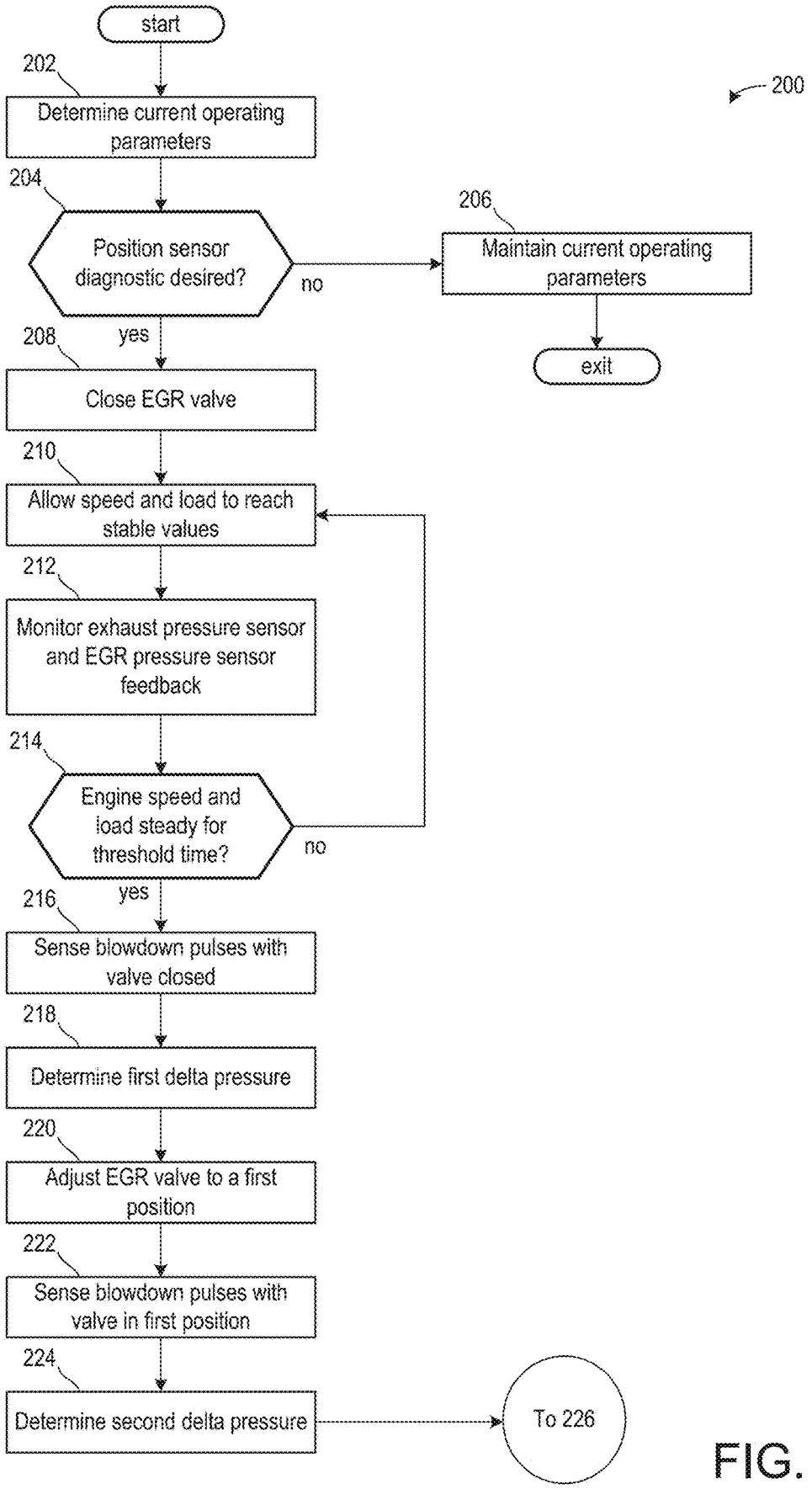
FIG. 2 illustrates a method for inferring an EGR valve position sensor functionality based on a blowdown peak pressure.
Figure 2:
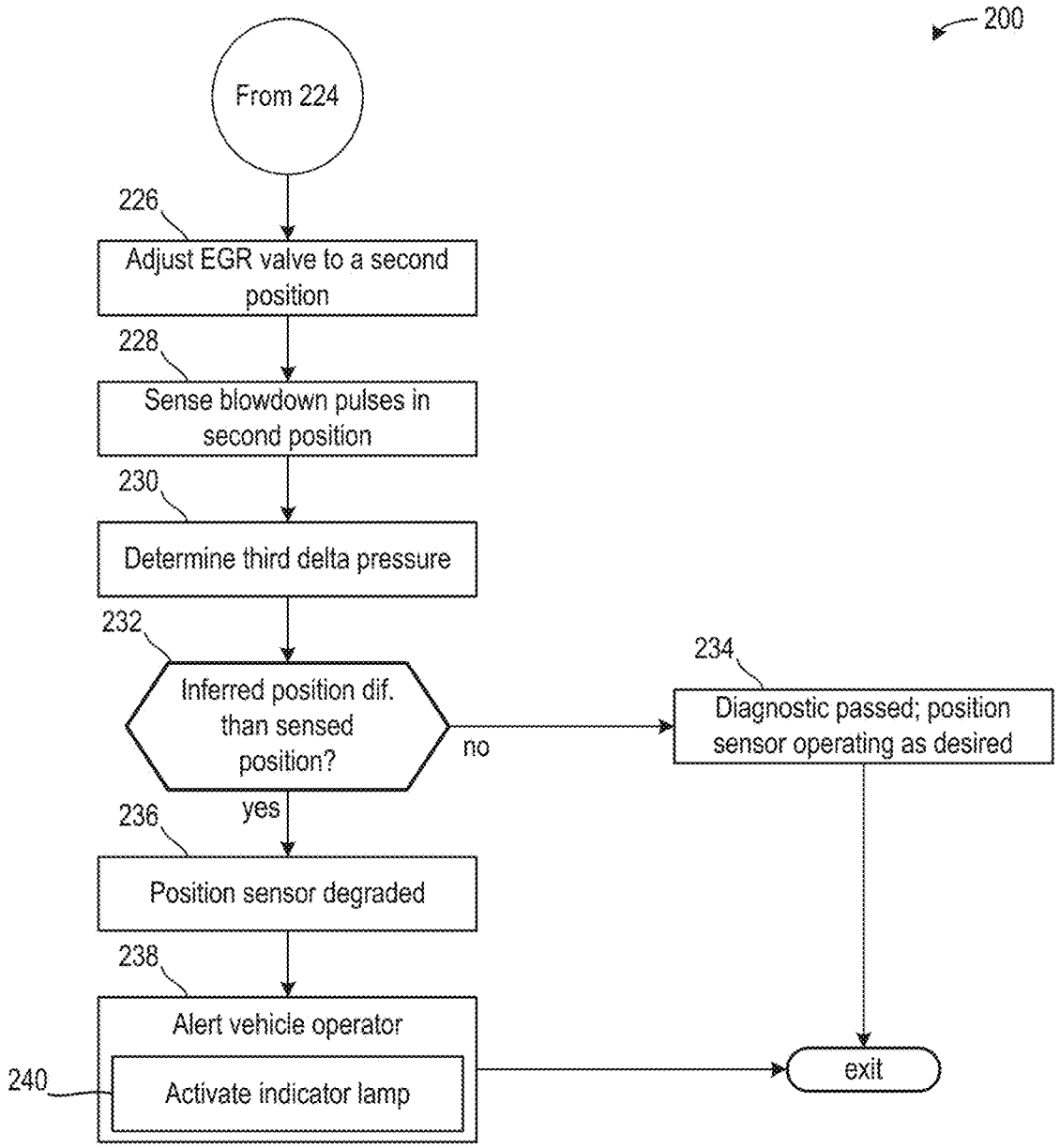
Figure 3:
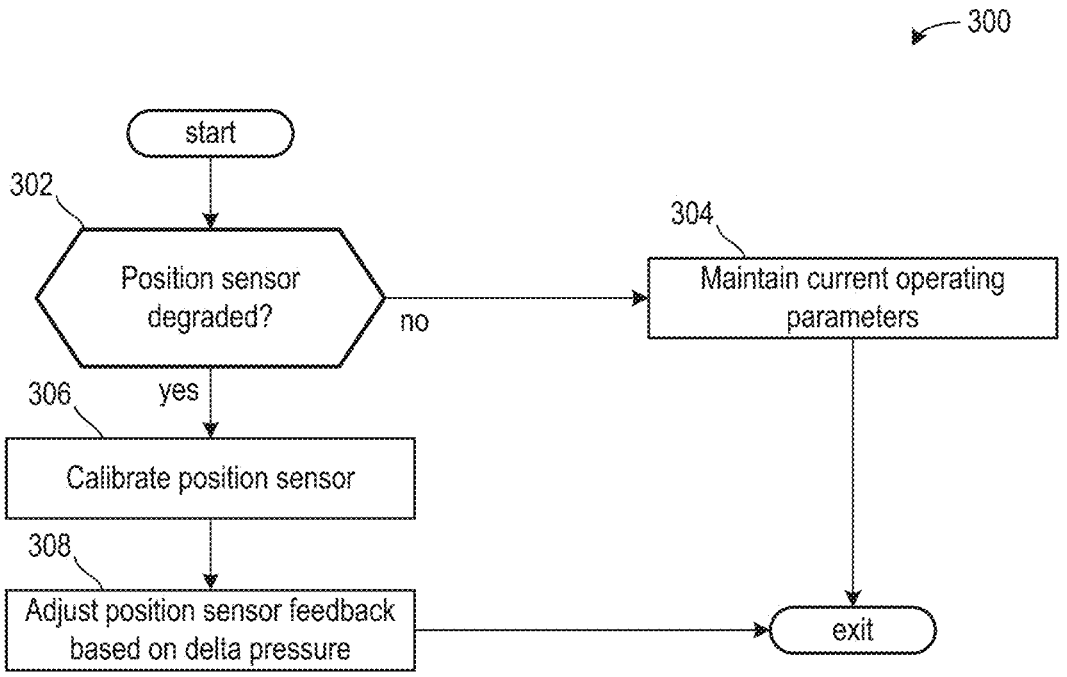
FIG. 3 illustrates a method for calibrating the EGR valve position sensor.

The following description relates to systems and methods for an EGR system. The high-pressure (HP) EGR system may comprise a delta pressure over the valve (DPOV) configuration, wherein two independent pressure sensors are arranged upstream and downstream of an EGR valve. The HP-EGR system is free of a fixed orifice delta pressure sensor and may rely on the two pressure sensors to regulate EGR flow through the EGR system in combination with the EGR valve. An example of the HP-EGR system arranged in an engine system of a hybrid vehicle is illustrated in FIG. 1. FIG. 2 illustrates a method for determining a degradation of a position sensor of an EGR valve of the EGR system. FIG. 3 illustrates a method for calibrating the position sensor of the EGR valve. FIGS. 4A, 4B, 4C, and 4D illustrate measured blowdown peak differential pressures sensed at various EGR valve positions. FIG. 5 graphically illustrates adjustments to a duty cycle in response to the calibration of the EGR valve position sensor.

FIG. 1 shows a schematic depiction of a hybrid vehicle system 6 that can derive propulsion power from engine system 8 and/or an on-board energy storage device. An energy conversion device, such as a generator, may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. The engine intake manifold 44 may further comprise a manifold absolute pressure (MAP) sensor 95. Engine exhaust 25 includes an exhaust manifold 48 leading to an exhaust passage 35 that routes exhaust gas to the atmosphere. Engine exhaust 25 may include at least one emission control device 70 mounted in a close-coupled position or in a far underbody position. The emission control device 70 may include a three-way catalyst, lean NOx trap, particulate filter, oxidation catalyst, etc. It will be appreciated that other components may be included in the engine such as a variety of valves and sensors, as further elaborated herein. In some embodiments, wherein engine system 8 is a boosted engine system, the engine system may further include a boosting device, such as a turbocharger (not shown).

In the example of the present disclosure, the emission control device 70 is a particulate filter 70. In one example, the particulate filter 70 is a gasoline particulate filter. In another example, the particulate filter 70 is a diesel particulate filter.

The engine system 8 further comprises a turbocharger having a compressor 82 and a turbine 84. The compressor 82 and the turbine 84 are mechanically coupled via a shaft 86. The turbine 84 may be driven via exhaust gases flowing through the exhaust passage 35. The exhaust gases may rotate a rotor of the turbine 84, which may rotate the shaft 86, resulting in rotation of a rotor of the compressor 82. The compressor 82 is configured to receive and compress intake air.

The engine system 8 further comprises an exhaust-gas recirculation (EGR) system 130. In the example of FIG. 1, the EGR system 130 is a high-pressure EGR system where exhaust gases are drawn from a location of the engine exhaust 25 upstream of the turbine 84. The EGR system 130 comprises an EGR valve 134 arranged upstream of a heat exchanger 138, relative to a direction of exhaust gas flow in an EGR passage 132.

The EGR system 130 further comprises an exhaust gas pressure sensor 135, an EGR pressure sensor 136, and a temperature sensor 139. The exhaust gas pressure sensor 135 may be arranged upstream of the EGR valve 134 and the EGR pressure sensor 136 may be arranged downstream of the EGR valve, relative to a direction of exhaust gas flow, between the EGR valve 134 and the heat exchanger 138. The temperature sensor 139 may be arranged downstream of the heat exchanger 138. Each of the exhaust gas pressure sensor 135, the EGR pressure sensor 136, and the temperature sensor 139 may be configured to provide feedback to the controller 12. As illustrated, the EGR system 130 is a high-pressure EGR system free of a fixed orifice delta pressure sensor.

An EGR valve position sensor 137 may be configured to provide feedback to the controller 12 with regard to a position of the EGR valve 134. In some examples, an accuracy of the EGR valve position sensor 137 may degrade, which may result in the controller commanding an inaccurate position of the EGR valve 134. As will be described below, during some conditions, a diagnostic of the EGR valve position sensor 137 may be executed via cross-checking feedback from the EGR valve position sensor 137 to an inferred position of the EGR valve 134 based on a differential of a blowdown pressure pulse sensed at each of the exhaust gas pressure sensor 135 and the EGR pressure sensor 136 at one or more positions of the EGR valve 134.

In one example, the heat exchanger 138 may be a liquid-to-liquid or an air-to-liquid cooler. The heat exchanger 138 may be configured to receive coolant from a cooling system of the hybrid vehicle 6, such as an engine cooling system or other similar cooling system. Additionally or alternatively, the heat exchanger 138 may comprise a cooling system separate from other cooling systems of the hybrid vehicle 6. In some examples, a bypass passage may be included in the EGR system 130, wherein the bypass passage is configured to flow pressurized exhaust gases around the heat exchanger 138 during conditions where cooling may not be desired. In one example, cooling may not be desired during conditions where an engine temperature is less than a desired temperature, such as during a cold-start.

In the example of FIG. 1, the hybrid vehicle 6 further comprises a low-pressure (LP) EGR passage 142. The LP-EGR passage 142 is configured to divert exhaust gases from downstream of the turbine 84 to a portion of the intake passage 42 upstream of the compressor 82. Additionally or alternatively, in some examples, the hybrid vehicle 6 may be configured without the LP-EGR passage 142 without departing from the scope of the present disclosure.

Hybrid vehicle 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, and pressure sensor 129. Other sensors such as additional pressure, temperature, air/fuel ratio, and composition sensors may be coupled to various locations in the vehicle system 6. As another example, the actuators may include the throttle 62.

Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, hybrid vehicle 6 comprises multiple sources of torque available to one or more vehicle wheels 59. In other examples, vehicle 6 is a conventional vehicle with only an engine, or an electric vehicle with only electric machine(s). In the example shown, vehicle 6 includes engine 10 and the electric machine 51. Electric machine 51 may be a motor or a motor/generator. A crankshaft of engine 10 and electric machine 51 may be connected via a transmission 54 to vehicle wheels 59 when one or more clutches 56 are engaged. In the depicted example, a first clutch 56 is provided between a crankshaft and the electric machine 51, and a second clutch 56 is provided between electric machine 51 and transmission 54. Controller 12 may send a signal to an actuator of each clutch 56 to engage or disengage the clutch, so as to connect or disconnect the crankshaft from electric machine 51 and the components connected thereto, and/or connect or disconnect electric machine 51 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 51 receives electrical power from a traction battery 61 to provide torque to vehicle wheels 59. Electric machine 51 may also be operated as a generator to provide electrical power to charge battery 61, for example during a braking operation.

As will be described herein, pressure sensors of the EGR system 130 may be periodically diagnosed for operation outside of a desired tolerance. The desired tolerance may be relatively small such that errors detected during the diagnostic may also be relatively small. As such, determining these errors may be relatively challenging without additional sensors or advanced hardware. Herein, methods are described for detecting errors in the sensors in a low-cost system without additional sensors and hardware relative to those shown in the example of FIG. 1.

FIG. 1 shows an example configuration with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Turning now to FIG. 2, it shows a method 200 for inferring a position of an EGR valve via sensing a blowdown peak pressure at two or more EGR valve positions. Differential pressures measured across the EGR valve may be used to diagnose a condition of an EGR valve position sensor. In one example, the position of the EGR valve may be inferred based on the differential pressure, which may be compared to feedback from the EGR valve position sensor. Instructions for carrying out method 200 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

The method 200 begins at 202, which includes determining current operating parameters. Current operating parameters may include but are not limited to one or more of a manifold vacuum, a throttle position, an engine speed, a vehicle speed, an EGR flow rate, and an air/fuel ratio.

The method 200 may proceed to 204, which includes determining if an EGR valve position sensor diagnostic is desired. The EGR valve position diagnostic may be desired in response to one or more of a predetermined time and/or distance elapsing, a combustion chamber mixture dilution being different than a desired amount, and/or entry conditions to the position sensor diagnostic being met. In one example, the predetermined time may be based on a number of hours, days, weeks, and/or months. Additionally or alternatively, the predetermined distance may be 50 miles, 100 miles, or the like, where it may be desired to execute the diagnostic periodically based on a distance driven. The combustion chamber mixture dilution being different than the desired amount, which may be determined in response to an engine temperature being less than a desired temperature, a combustion timing being later than a desired combustion timing, an engine power output being different than a desired power output, and the like. Entry conditions to executing the position sensor diagnostic may include one or more of the predetermined time elapsing, the predetermine distance being traveled, the combustion chamber mixture dilution being different than the desired amount, EGR not being desired, and/or a steady state condition being met.

If the position sensor diagnostic is not desired and/or if the position sensor diagnostic conditions are met, then the method 200 may proceed to 206, which may include maintaining current operating parameters and not executing the EGR valve position sensor diagnostic.

If the position sensor diagnostic is desired and/or if conditions are/will be met, then the method 200 may proceed to 208, which includes closing the EGR valve. In one example, closing the EGR valve includes where a controller signals to an actuator of the EGR valve to move the EGR valve to a fully closed position. The fully closed position may correspond to a position where EGR flow through the EGR valve is blocked. The signal from the controller to the actuator may correspond to a duty cycle, which may control an opening and a closing of the valve based on a steady current of electrical energy being converted into pulses. Additionally or alternatively, actuation of the EGR valve to the fully closed position may be based on feedback from the EGR valve position sensor. That is to say, the EGR valve is commanded closed and determination of its actuation to the closed position may be based on only feedback from the EGR valve position sensor during the EGR valve position sensor diagnostic.

The method 200 may proceed to 210, which includes allowing an engine rotations-per-minute (RPM) and an engine load to reach stable values. Herein, stable engine speed and/or load is based on an engine speed and/or load remaining within ±5-10% of a fixed value. As such, a transient condition may not be occurring during the diagnostic. In some examples, stable values may be achieved during idle, low, mid, and/or high-loads. Additionally or alternatively, the diagnostic may not be executed during an engine off or a coasting event.

The method 200 may proceed to 212, which includes monitoring feedback from the exhaust gas pressure sensor and the EGR pressure sensor. Monitoring the feedback may include measuring blowdown pressure pulses sensed at the sensors being relatively constant to determine if conditions for the diagnostic are met.

The method 200 may proceed to 214, which includes determining if the engine speed and/or the engine load are steady for a threshold time. In one example, the threshold time is based on a non-zero, fixed amount of time in which the engine speed and engine load remain constant. In one example, the threshold time may be 2 seconds or greater. In some examples, additionally or alternatively, the threshold time may be 5 seconds or greater.

If the engine speed and/or engine load are not steady, then the method 200 may return to 210 to continue allowing the speed and load to reach steady values for the threshold time.

If the engine speed and/or engine load are steady, then the method 200 may proceed to 216, which includes sensing blowdown pulses with the EGR valve fully closed. In this way, a blowdown pulse at each of the exhaust gas pressure sensor and the EGR pressure sensor is sensed.

The method 200 may proceed to 218, which may include determining a first differential pressure. The first differential pressure may be based on a difference between the blowdown pulse sensed at the exhaust gas pressure sensor and the blowdown pulse sensed at the EGR pressure sensor. In one example, the EGR valve in the fully closed position may muffle and/or dampen the blowdown pulse reaching the EGR pressure sensor such that the first differential pressure is relatively large compared to other differential pressures sensed at other positions of the EGR valve.

The method 200 may proceed to 220, which may include adjusting the EGR valve to a first position. In one example, the first position may include a position between the fully closed position and a fully open position of the EGR valve such that the valve is partially open. In one example, the first position may be equal to a 50% open position. As another example, the first position may be less than the 50% open position, such as 40% or less. In this way, an amount of EGR may flow through the EGR valve when the EGR valve is in the first position. In one example, engine operating conditions may be adjusted during the diagnostic of the EGR valve position sensor to accommodate the flow of EGR. For example, air flow to the engine may be reduced.

The method 200 may proceed to 222, which may include sensing blowdown pulses with the EGR valve in the first position.

The method 200 may proceed to 224, which may include determining a second differential pressure. In one example, the second differential pressure may correspond to a difference between the blowdown pulses sensed at the exhaust gas pressure sensor and the EGR pressure sensor. In one example, the second differential pressure may be less than the first differential pressure when the EGR valve position sensor is not degraded.

The method 200 may proceed to 226, which includes adjusting the EGR valve to a second position. In one example, the second position may correspond to a position more open than the first position. In one example, the second position may be a fully open position. In some examples, additionally or alternatively, the second position may be greater than 50% open. Actuation of the EGR valve to the second position may be based on feedback from the EGR valve position sensor during the EGR valve position sensor diagnostic. In one example, the controller signals the actuator to open the EGR valve to the second position, wherein the controller signals the actuator to maintain the second position in response to the EGR valve position sensor indicating the second position is reached.

The method 200 may proceed to 228, which includes sensing blowdown pulses in the second position.

The method 200 may proceed to 230, which includes determining a third differential pressure. In one example, the third differential pressure may be less than each of the second and first differential pressures.

The method 200 may proceed to 232, which may include determining if one or more of the inferred positions is different than a sensed position. The inferred positions may be based on a calculated differential pressure, such as the first, second, or third differential pressures, and may be compared to feedback from the EGR valve position sensor at each of the closed, first, and second positions. That is to say, the first differential pressure may be compared to feedback from the EGR valve position sensor at the closed position, the second differential pressure may be compared to feedback from the EGR valve position sensor at the first position, and the third differential pressure may be compared to feedback from the EGR valve position sensor at the second position. In one example, if one or more of the inferred positions is different than the sensed position, then the EGR valve position sensor may be degraded. As another example, if all the inferred positions are different than corresponding sensed positions, then the EGR valve position sensor may be degraded.

In one example, additionally or alternatively, the differential pressures may be compared to predetermined differential pressures for each of the diagnostic positions of the EGR valve. If the differential pressure is different than the predetermined differential pressure by a threshold range, then the EGR valve position sensor may be degraded. For example, the threshold range may be ±5% of the predetermined delta pressure. It will be appreciated that the threshold range may be other values (e.g., ±10%, ±2%, ±1%, etc.) without departing from the scope of the present disclosure. Thus, the first delta pressure may be compared to a first predetermined delta pressure, the second delta pressure may be compared to a second predetermined delta pressure, and the third delta pressure may be compared to a third predetermined delta pressure. Examples of the predetermined delta pressures are illustrated in FIGS. 4A to 4D.

If each of the inferred positions matches a corresponding sensed position, then the method 200 may proceed to 234, which includes indicating the diagnostic is passed and the EGR valve position sensor is operating as desired. As such, feedback from the EGR valve position sensor may be reliably used to a gauge a position of the EGR valve.

If one or more of the inferred positions is different than the corresponding sensed position, then the method 200 may proceed to 236, which includes indicating that the EGR valve position sensor is degraded. In one example, only the positions of the EGR valve where the sensed position is different than the corresponding position may be indicated as degraded. For example, the indication may include indicating that the EGR valve position sensor is degraded for only the third position in response to the inferred third position not matching the sensed third position.

The method 200 may proceed to 238, which may include alerting the vehicle operator. Alerting the vehicle operator may include activating an indicator lamp 240. Additionally or alternatively, alerting the vehicle operator may include a message on an infotainment device, a text, an email, a phone call, or the like. Additionally or alternatively, alerting the vehicle operator may be optional based on a number of positions in which the EGR valve position sensor is degraded.

In some examples, additionally or alternatively, the engine operating parameters at the positions of the EGR valve where the EGR valve position sensor is degraded may be adjusted. Adjustments may include limiting an engine power output, adjusting a fuel volume, adjusting a fuel timing, adjusting a spark timing, adjusting an air/flow rate, and the like.

Turning now to FIG. 3, it shows a method 300 for calibrating degraded positions of the EGR valve position sensor. In this way, feedback from the EGR valve position sensor may be modified to more accurately match a current position of the EGR valve. In one example, the calibrating may include adjusting feedback from the position sensor based on a difference between the determined delta pressure of the degraded position and the predetermined delta pressure of the position.

The method 300 begins at 302, which includes determining if the EGR valve position sensor is degraded. As described above with respect to the diagnostic method 200 of FIG. 2, the EGR valve position sensor may be degraded for one or more positions of the EGR valve in response to a comparison of an inferred position being different than a sensed position. If the EGR valve position sensor is not degraded, then the method 300 may proceed to 304, which may include maintaining current operating parameters and not calibrating the EGR valve position sensor.

If the position sensor is degraded, then the method 300 may proceed to 306, which may include calibrating the position sensor. Calibration of the position sensor may be based on a difference between the inferred position and the sensed position. For example, if the inferred position corresponds to a more open position than the sensed position, then future feedback from the EGR valve position sensor may be adjusted based on the difference. Additionally or alternatively, a difference between the differential pressure and the predetermined delta pressure may be used to calibrate the EGR valve position sensor. For example, if the first position of the EGR valve position sensor is degraded, and the predetermined delta pressure is 30 kPa and the delta pressure determined during the diagnostic is 25 kPa, then the calibration may be based on the difference between 30 and 25 kPa. In one example, feedback from the EGR valve position sensor is indicating a more closed position than an actual position of the EGR valve, which results in the controller signaling to actuate the EGR valve to a more open position, allowing a greater amount of the blowdown pressures to reach the EGR pressure sensor.

The method 300 may proceed to 308, which includes adjusting feedback from the EGR valve position sensor. Continuing with the example above, feedback from the EGR valve position sensor is adjusted based on the difference between the inferred position and the sensed position, wherein a value of the difference may be proportional to an adjustment (e.g., a calibration) of the feedback from the EGR valve position sensor.

Additionally or alternatively, in some examples, the predetermined differential pressure and the sensed differential pressure of a given diagnostic position of the EGR valve may be used for the calibration such that future feedback from the EGR valve position sensor used to adjust a position of the EGR valve may result in sensed differential pressures more closely matching the predetermined delta pressure. Thus for the example of 306, feedback from the EGR valve position sensor is adjusted to indicate a more open position, relative to the more closed position that was incorrectly indicated, to more closely resemble the actual position and cure the degradation. By doing this, the EGR valve position sensor may be calibrated to correct degradations, which may extend a life of the EGR valve position sensor.

Turning now to FIGS. 4A, 4B, 4C, and 4D, they show embodiments 400, 425, 450, and 475, respectively, of predetermined pressures of various positions of the EGR valve. The predetermined pressures may be determined by a vehicle manufacturer and stored in a multi-input look-up table on memory of the controller. Inputs may include but are not limited to engine speed, engine load, exhaust temperature, engine temperature, throttle position, and the like.

Embodiment 400 illustrates an example blowdown pulse pressure plot with feedback from the exhaust gas pressure sensor indicated via plot 402, feedback from the EGR pressure sensor indicated via plot 404, and a manifold pressure indicated via plot 406. The example of FIG. 4A may illustrate a fully closed EGR valve position. As such, the EGR pressure sensor feedback 404 may track the manifold pressure plot 406. Furthermore, a first differential pressure 408, calculating a difference between pressures of the exhaust gas pressure sensor feedback 402 and the EGR pressure sensor feedback 404 is illustrated.

Figure 4B:
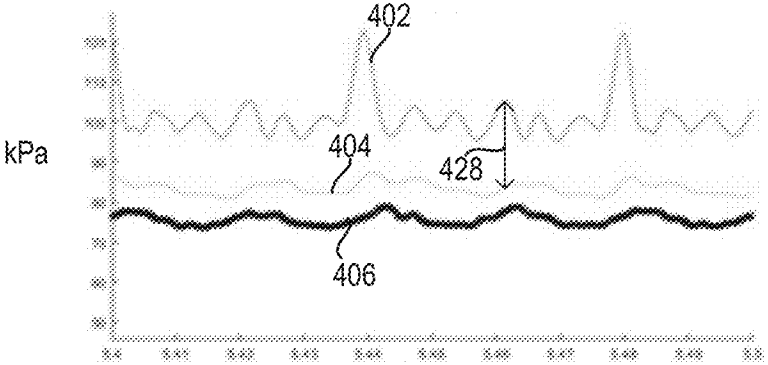
FIGS. 4A, 4B, 4C, and 4D illustrate different blowdown peak pressures during different positions of the EGR valve during a diagnostic routine for monitoring a condition of the EGR valve position sensor.
Figure 4A:
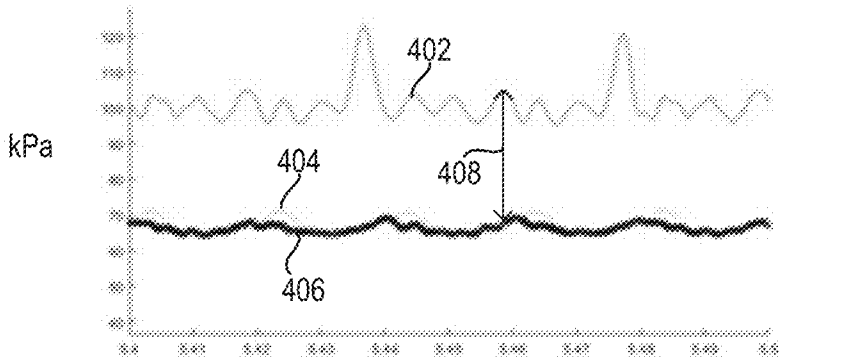
Figure 5:
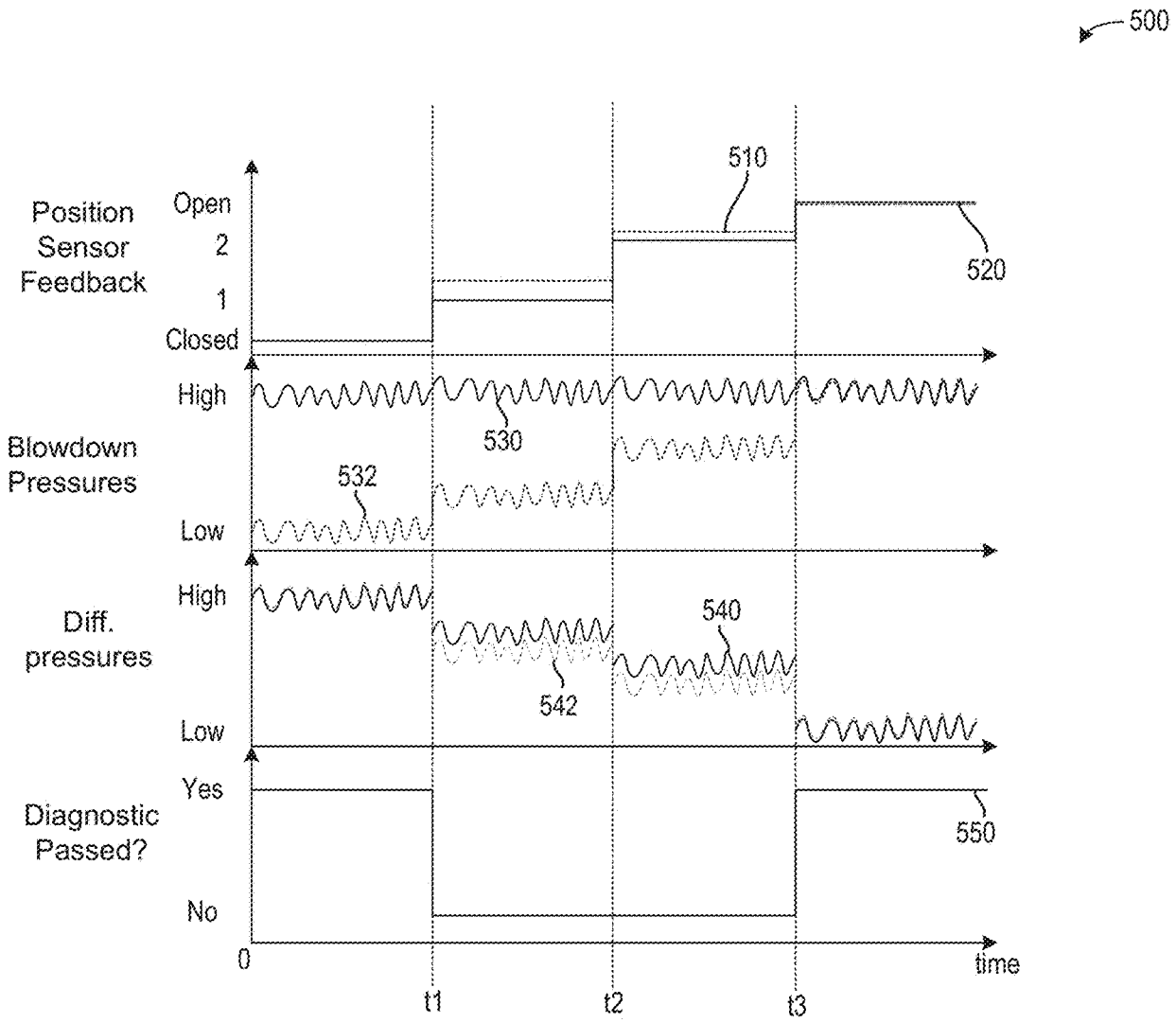
FIG. 5 graphically illustrates adjustments to a duty cycle in response to a calibration of the EGR valve position sensor.

Embodiment 425 of FIG. 4B illustrates an example blowdown pulse pressure plot with the EGR valve in a second position, more open than the first position of FIG. 4A. As such, the EGR pressure sensor feedback 404 increases relative to the example of FIG. 4A such that the blowdown pulse pressure sensed at the EGR pressure sensor is greater than the manifold pressure. Furthermore, a second differential pressure 428 may be calculated, wherein the second differential pressure 428 is less than the first differential pressure 408.

Figure 4D:
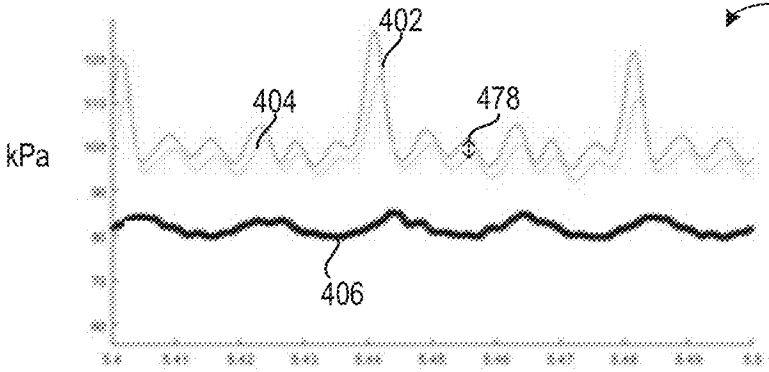
Figure 4C:
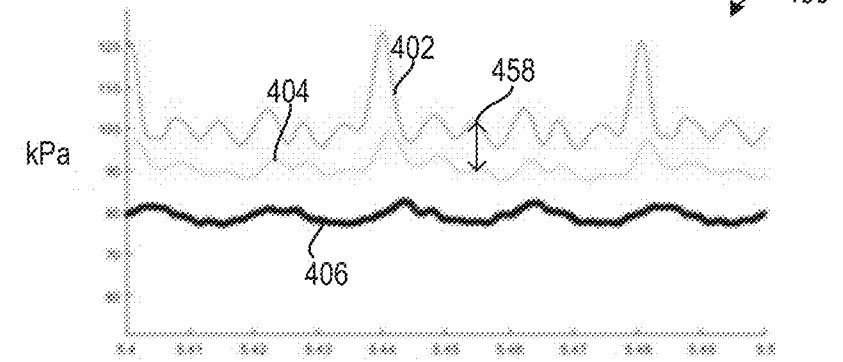

Embodiment 450 of FIG. 4C illustrates an example blowdown pulse pressure plot with the EGR valve in a third position, more open than the second position of FIG. 4B. As such, the EGR pressure sensor feedback 404 increases relative to the example of FIG. 4B. Furthermore, a third differential pressure 458 may be calculated, wherein the third differential pressure 458 is less than the second differential pressure 428.

Embodiment 475 of FIG. 4D illustrates an example blowdown pulse pressure plot with the EGR valve in a fourth position, more open than the second position of FIG. 4C. In one example, the fourth position may correspond to a fully open position of the EGR valve. As such, the EGR pressure sensor feedback 404 increases relative to the example of FIG. 4C such that the EGR pressure sensor feedback 404 may track the exhaust gas pressure sensor feedback 402. Furthermore, a fourth differential pressure 478 may be calculated, wherein the fourth differential pressure 478 is less than the third differential pressure 458.

In one example, each of the first differential pressure 408, the second differential pressure 428, the third differential pressure 458, and the fourth differential pressure 478 may be stored in a multi-input look-up table. Sensed differential pressures during the diagnostic method 200 of FIG. 2 may be used to infer the position of the EGR valve based on the examples of FIGS. 4A-4D. If the inferred position is different than the sensed position based on feedback from the EGR valve position sensor, then the sensor may be degraded.

Turning now to FIG. 5, it shows a graph 500 graphically illustrating execution of the diagnostic method 200 of FIG. 2 in combination with adjustments to the EGR system 130 of FIG. 1. Plot 510 illustrates an inferred EGR valve position based on a differential pressure. Plot 520 illustrates an EGR valve position sensor feedback. Plot 530 illustrates an exhaust gas pressure sensor feedback and plot 532 illustrates an EGR pressure sensor feedback. Plot 540 illustrates a predetermined differential pressure of the desired EGR valve position and plot 542 illustrates a current predetermined differential pressure. Plot 550 illustrates the diagnostic is passed or failed. Time is graphed along an abscissa and increases from a left to a right side of the figure.

Prior to t1, the diagnostic begins by actuating the EGR valve to a fully closed position. The valve may be actuated based on feedback from the EGR valve position sensor (plot 520). Blowdown pressure pulses may be sensed via the exhaust gas pressure sensor (plot 530) and the EGR pressure sensor (plot 532). A sensed differential pressure (plot 542) calculated based on a difference between plots 530 and 532 may be compared to a predetermined differential pressure (plot 540) previously determined for the EGR valve fully closed position. Since the sensed differential pressure is substantially equal to the predetermined differential pressure, the diagnostic is passed at the fully closed position. This is further illustrated in response to an inferred position of the EGR valve (plot 510) matching the EGR valve position sensor feedback.

At t1, the diagnostic progresses and the EGR valve is actuated to a first position.

Between t1 and t2, the blowdown pressure pulses are sensed via the exhaust gas and EGR pressure sensors. The differential pressure thereof is compared to a predetermined pressure differential of the first position. As shown, a difference between the differential pressure and the predetermined pressure exists, resulting in the diagnostic not passing. This is further illustrated via a difference in the EGR valve position sensor feedback and the inferred EGR valve position, which is based on the differential pressure calculated between t1 and t2.

At t2, the diagnostic method advances and the EGR valve is moved to a second position.

Between t2 and t3, the blowdown pressure pulses are sensed via the exhaust gas and EGR pressure sensors. The differential pressure thereof is compared to a predetermined pressure differential of the second position. As shown, a difference between the differential pressure and the predetermined pressure exists, resulting in the diagnostic not passing. This is further illustrated via a difference in the EGR valve position sensor feedback and the inferred EGR valve position, which is based on the differential pressure calculated between t2 and t3.

At t3, the diagnostic method advances and the EGR valve is moved to a fully open position.

After t3, the blowdown pressure pulses are sensed via the exhaust gas and EGR pressure sensors. The differential pressure thereof is compared to a predetermined pressure differential of the second position. As shown, a difference between the differential pressure and the predetermined pressure does not exist, resulting in the diagnostic passing. This is further illustrated via no difference between the EGR valve position sensor feedback and the inferred EGR valve position.

In this way, calibrations of EGR position sensor may occur for only the first and second positons. The calibrations may include adjusting feedback from the position sensor to match the inferred positions of the diagnostic method.

The technical effect of inferring a position of an EGR valve via determining a differential pressure at two or more positions of the EGR valve is to determine a condition of an EGR valve position sensor. By doing this, the operation of the sensor may be enhanced which may result in more accurate EGR flow, thereby enhancing engine operating parameters.

An embodiment of a method includes inferring an EGR valve position sensor functionality based on a blowdown peak pressure during a closed EGR valve operation and at least one open EGR valve position. A first example of the method further includes where sensing the blowdown peak pressure via an exhaust gas pressure sensor and an EGR pressure sensor. A second example of the method, optionally including the first example, further includes where comparing feedback from the EGR valve position sensor to an inferred position of an EGR valve in response to a difference between the blowdown peak pressure sensed via the exhaust gas pressure sensor and the EGR pressure sensor. A third example of the method, optionally including one or more of the previous examples, further includes where indicating a degradation of the EGR valve position sensor in response to the difference being different than a predetermined difference. A fourth example of the method, optionally including one or more of the previous examples, further includes where indicating no degradation of the EGR valve position sensor in response to the difference being equal to a predetermined difference. A fifth example of the method, optionally including one or more of the previous examples, further includes where an engine speed and an engine load are constant.

An embodiment of a system includes a differential pressure over valve (DPOV) based high-pressure exhaust-gas recirculation (HP-EGR) system, an exhaust gas pressure sensor arranged upstream of an EGR valve relative to a direction of exhaust gas flow, an EGR pressure sensor arranged downstream of the EGR valve relative to the direction of exhaust gas flow, an EGR valve position sensor configured to sense a position of the EGR valve, and a controller with computer-readable instructions stored on non-transitory memory thereof that when executed enable the controller to infer a position of the EGR valve based on a blowdown peak pressure differential at one or more EGR valve positions based on feedback from the exhaust gas pressure sensor and the EGR pressure sensor. A first example of the system further includes where the instructions further enable the controller to compare the inferred position of the EGR valve to a sensed position of the EGR valve sensed via the EGR valve position sensor. A second example of the system, optionally including the first example, further includes where the instructions further enable the controller to determine a degradation of the EGR valve position sensor in response to the inferred position being different than the sensed position. A third example of the system, optionally including one or more of the previous examples, further includes where the instructions further enable the controller to indicate no degradation of the EGR valve in response to the inferred position matching the sensed position. A fourth example of the system, optionally including one or more of the previous examples, further includes where the one or more positions include a fully closed EGR valve position, a partially open EGR valve position, and a fully open EGR valve position. A fifth example of the system, optionally including one or more of the previous examples, further includes where the instructions further enable the controller to calibrate the EGR valve position sensor in response to a degradation of the EGR valve position sensor at one or more of the one or more positions. A sixth example of the system, optionally including one or more of the previous examples, further includes where the EGR valve position sensor is calibrated based on a difference between the inferred position and a sensed position. A seventh example of the system, optionally including one or more of the previous examples, further includes where the instructions further enable the controller to activate an indicator lamp in response to the inferred position being different than a sensed position. An eighth example of the system, optionally including one or more of the previous examples, further includes where the differential pressure over valve (DPOV) based high-pressure exhaust-gas recirculation (HP-EGR) system is free of a fixed orifice delta pressure sensor.

An embodiment of a system for a high-pressure exhaust-gas recirculation system includes an exhaust gas pressure sensor arranged upstream of an EGR valve relative to a direction of exhaust gas flow, an EGR pressure sensor arranged downstream of the EGR valve relative to the direction of exhaust gas flow, an EGR valve position sensor configured to sense a position of the EGR valve, and a controller with computer-readable instructions stored on non-transitory memory thereof that when executed enable the controller to during a diagnostic of the EGR valve position sensor, infer a position of the EGR valve based on a blowdown peak pressure differential at a closed EGR valve position and one or more open EGR valve positions, and compare the inferred position to a sensed position. A first example of the system further includes where the blowdown peak pressure differential is based on a difference between feedback from the EGR pressure sensor and feedback from the exhaust gas pressure sensor. A second example of the system, optionally including the first example, further includes where the instructions further enable the controller to indicate a degradation of the EGR valve position sensor in response to a difference of the inferred position and the second position during the diagnostic. A third example of the system, optionally including one or more of the previous examples, further includes where the degradation corresponds positions of the EGR valve at which the inferred position and the sensed position are different. A fourth example of the system, optionally including one or more of the previous examples, further includes where the diagnostic is executed during a fixed engine speed or a fixed engine load.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

inferring an EGR valve position sensor functionality based on a blowdown peak pressure during a closed EGR valve operation and at least one open EGR valve position.

2. The method of claim 1, further comprising sensing the blowdown peak pressure via an exhaust gas pressure sensor and an EGR pressure sensor.

3. The method of claim 2, further comprising comparing feedback from the EGR valve position sensor to an inferred position of an EGR valve in response to a difference between the blowdown peak pressure sensed via the exhaust gas pressure sensor and the EGR pressure sensor.

4. The method of claim 3, further comprising indicating a degradation of the EGR valve position sensor in response to the difference being different than a predetermined difference.

5. The method of claim 3, further comprising indicating no degradation of the EGR valve position sensor in response to the difference being equal to a predetermined difference.

6. The method of claim 1, further comprising wherein an engine speed and an engine load are constant.

7. A system, comprising:

a differential pressure over valve (DPOV) based high-pressure exhaust-gas recirculation (HP-EGR) system;

an exhaust gas pressure sensor arranged upstream of an EGR valve relative to a direction of exhaust gas flow;

an EGR pressure sensor arranged downstream of the EGR valve relative to the direction of exhaust gas flow;

an EGR valve position sensor configured to sense a position of the EGR valve; and a controller with computer-readable instructions stored on non-transitory memory thereof that when executed enable the controller to:

infer a position of the EGR valve based on a blowdown peak pressure differential at one or more EGR valve positions based on feedback from the exhaust gas pressure sensor and the EGR pressure sensor.

8. The system of claim 7, wherein the instructions further enable the controller to compare the inferred position of the EGR valve to a sensed position of the EGR valve sensed via the EGR valve position sensor.

9. The system of claim 8, wherein the instructions further enable the controller to determine a degradation of the EGR valve position sensor in response to the inferred position being different than the sensed position.

10. The system of claim 8, wherein the instructions further enable the controller to indicate no degradation of the EGR valve in response to the inferred position matching the sensed position.

11. The system of claim 7, wherein the one or more positions include a fully closed EGR valve position, a partially open EGR valve position, and a fully open EGR valve position.

12. The system of claim 11, wherein the instructions further enable the controller to calibrate the EGR valve position sensor in response to a degradation of the EGR valve position sensor at one or more of the one or more positions.

13. The system of claim 12, wherein the EGR valve position sensor is calibrated based on a difference between the inferred position and a sensed position.

14. The system of claim 7, wherein the instructions further enable the controller to activate an indicator lamp in response to the inferred position being different than a sensed position.

15. The system of claim 7, wherein the differential pressure over valve (DPOV) based high-pressure exhaust-gas recirculation (HP-EGR) system is free of a fixed orifice delta pressure sensor.

16. A system for a high-pressure exhaust-gas recirculation system, comprising:

an exhaust gas pressure sensor arranged upstream of an EGR valve relative to a direction of exhaust gas flow;

an EGR pressure sensor arranged downstream of the EGR valve relative to the direction of exhaust gas flow;

an EGR valve position sensor configured to sense a position of the EGR valve; and a controller with computer-readable instructions stored on non-transitory memory thereof that when executed enable the controller to:

during a diagnostic of the EGR valve position sensor, infer a position of the EGR valve based on a blowdown peak pressure differential at a closed EGR valve position and one or more open EGR valve positions; and compare the inferred position to a sensed position.

17. The system of claim 16, wherein the blowdown peak pressure differential is based on a difference between feedback from the EGR pressure sensor and feedback from the exhaust gas pressure sensor.

18. The system of claim 16, wherein the instructions further enable the controller to indicate a degradation of the EGR valve position sensor in response to a difference of the inferred position and the second position during the diagnostic.

19. The system of claim 16, wherein the degradation corresponds positions of the EGR valve at which the inferred position and the sensed position are different.

20. The system of claim 16, wherein the diagnostic is executed during a fixed engine speed or a fixed engine load.

* * * * *